US005829751A

United States Patent [19]

Willis

[11] Patent Number: 5,829,751

[45] Date of Patent: Nov. 3, 1998

[54] HAND-HELD BASKETBALL GAME

[75] Inventor: Kenneth J. Willis, P.O. Box 527, Hollywood, Calif. 90078

[73] Assignee: Kenneth J. Willis, Hollywood, Calif.

[21] Appl. No.: 648,870

[22] Filed: May 16, 1996

[51] Int. Cl.[6] ..... A63B 67/10

[52] U.S. Cl. ..... 273/330; 473/507

[58] Field of Search ..... 273/317.3, 319, 273/320, 321, 329, 330, 331, 332, 333, 334, 335, 413, 414, 1.5 R, 1.5 A; 473/507

[56] References Cited

U.S. PATENT DOCUMENTS

| | | | |
|---|---|---|---|
| D. 307,040 | 4/1990 | Helalian | D21/62 |
| D. 326,483 | 5/1992 | Willis | D21/62 |
| 1,559,953 | 11/1925 | Furman | 273/321 |
| 2,042,984 | 6/1936 | Fritz | 273/321 X |
| 2,208,086 | 7/1940 | Singer | 273/330 |
| 2,243,019 | 5/1941 | Singer | 273/321 |
| 2,382,513 | 8/1945 | Singer | 273/321 |
| 2,570,860 | 10/1951 | Redding | 273/317.3 X |
| 2,882,054 | 4/1959 | Hilder | 273/321 |
| 3,012,785 | 12/1961 | O'Brien | 273/325 |
| 3,907,297 | 9/1975 | Di Leva | 273/320 |
| 5,338,026 | 8/1994 | Kregel | 273/1.5 R X |

*Primary Examiner*—William H. Grieb
*Attorney, Agent, or Firm*—Kenneth J. Willis

[57] ABSTRACT

The hand-held basketball game comprises of a circular-shaped disc mounted to a short tubular handle that has a spirally-grooved socket inserted within the front section of the short tubular handle, which is connected by inserting the miniature basketball game hoop's rear square-headed, spirally-grooved screw into a square opening located within the center base of the miniature beveled transparent basketball game backboard, which is connected to a spirally-grooved socket inserted within the front section of the short tubular handle. The hand-held basketball game includes a miniature cone-shaped basketball game net that can be assembled to and disconnected from the miniature basketball game hoop which has a small circular track lining designed within the inner circle frame of the miniature basketball game hoop that allows the miniature basketball game cone-shaped net to be adjustable to the miniature basketball game hoop. The hand-held basketball game also comprises of a small loophole made within the front center section of the miniature basketball game hoop which permits one end of the thin rubber string to be attached to the front center section of the rim of the miniature basketball game hoop, consequently allowing the thin rubber string to be attached to a small, circular, rimmed wedge plug which locks into place after being inserted into a small compatible hole located in the middle of the miniature basketball, which also operates as a reinforcement mechanism for both the miniature basketball and rubber string connection. This, in turn, assembles the hand-held basketball game into one complete unit. The hand-held basketball game is also comprised of a small white square designed within the center of the beveled miniature transparent basketball game backboard.

1 Claim, 3 Drawing Sheets

Hand Held Basketball Game

HAND-HELD BASKETBALL GAME

BACKGROUND OF THE INVENTION

1. Field of the Invention

The present invention relates to a hand-held basketball game, and in particular to a hand-held basketball game composition comprising of a short tubular handle, miniature transparent backboard, miniature hoop, miniature basketball game cone-shaped net, rubber string connected to a miniature basketball.

2. Description of the Prior Art

Many times, it is desirable to play a game of basketball during leisure indoor and outdoor activities. Such a basketball game should be easy to transport and require little effort to assemble. Normally, such a basketball game would be a large portable basketball game which cannot be easily transportable due to its weight and size.

Portable basketball games are well known in the art. However, the basketball game disclosed in prior art does not provide a versatile basketball game that is portable and can be played anywhere at anytime, which also provides a great form of entertainment for people of all ages. The hand-held basketball game helps develop hand and eye coordination, as well as hand, eye, and body reflexes which are utilized in a real physical game of basketball. However, the hand-held basketball game not only functions as a stress reliever but, also, is designed to be easily assembled for packing and marketing to different retail stores.

Some examples of the prior art of the hand-held basketball game and structures for support of articles are set forth in the patents briefly described below.

The Willis Pat. No. D326,483 discloses a hand-held basketball game designed for looping a miniature basketball into a miniature basketball game hoop, which includes a paddle design, miniature basketball game backboard, basketball game net, and miniature basketball which is attached to the miniature basketball game hoop by use of a thin string. In this designed display, however, the drawbacks are that the Willis hand-held basketball game design does not have a short tubular handle with a circular-shaped disc mounted to the base of the handle, nor is the prior art basketball game assembled by inserting a square-headed, spirally-grooved screw into a square opening located at the center base of a miniature beveled transparent basketball game backboard which connects to a spirally-grooved socket that is inserted within the front section of the tubular handle that attaches the miniature basketball game hoop, miniature basketball game cone-shaped net, basketball game thin rubber string, and miniature basketball into one single unit.

The preexisting hand-held basketball game does not have a miniature cone-shaped basketball game net that can be assembled to and disconnected from the miniature basketball game hoop, which has a circular track lining, designed within the inner circle frame of the miniature basketball game hoop that allows the basketball net to be adjustable to the miniature basketball game hoop.

The hand-held basketball game also does not have a small loophole made within the front center section of the miniature basketball game hoop which allows one end of the thin rubber string to be attached to the front center of the rim of the miniature basketball game hoop, consequently allowing the thin rubber string to be attached to a small, circular, rimmed wedge plug, which locks after being inserted into a small compatible opening located in the middle of the miniature basketball, which operates as a reinforcement mechanism for both the miniature basketball and rubber string connections. Other types of designs are described in:

| | | | | |
|---|---|---|---|---|
| 1. | U.S. Pat. No. D307.040 | 4-1990 | | D21/62 |
| 2. | 2,208.086 | 7-1940 | Singer | 273/330 |
| 3. | 2,882.054 | 4-1959 | Hilder | 273/321 |
| 4. | 3,012.785 | 12-1961 | O'Brien | 273/325 |

SUMMARY OF THE INVENTION

The principal objective of the present invention is to provide a device that helps the player with his hand, eye, and body coordination. Another objective of the present invention is to provide a device of simple and inexpensive construction. Still another objective is to provide a device of lightweight construction that can be assembled and disassembled quickly, and can be played within any open space environment. A further objective is to provide a device which, when in use, will increase the player's concentration, athletic ability, confidence, and motor skills.

The foregoing objective can be accomplished by providing an improved hand-held basketball game device, having a circular-shaped disc mounted to the base of a short tubular handle, which has a spirally-grooved socket inserted within the front section of the short tubular handle, which is connected by inserting the basketball game hoop rear square-headed, spirally-grooved screw into a square opening located within the center base of the miniature beveled transparent basketball game backboard which is connected to a spirally-grooved socket inserted within the front section of the short tubular handle. The hand-held basketball game includes a miniature cone-shaped basketball game net that can be assembled to and disconnected from the miniature basketball game hoop which has a small circular track lining designed within the inner circle frame of the basketball game hoop that allows the miniature basketball game cone-shaped net to be adjustable to the miniature basketball game hoop. The hand-held basketball game also comprises of a small loophole made within the front center section of the miniature basketball game hoop, which allows one end of the thin rubber string to be attached to the front center section of the rim of the miniature basketball game hoop, which allows the thin rubber string to be attached to a small, circular, rimmed wedge plug which locks into place after being inserted into a small compatible hole located in the middle of the miniature basketball, which also operates as a reinforcement mechanism for both the miniature basketball and rubber string connection. This, in turn, assembles the hand-held basketball game into one complete unit which makes the hand-held basketball game easy to package and market for retail store sales.

DESCRIPTION OF THE PREFERRED EMBODIMENT

Figure 1:
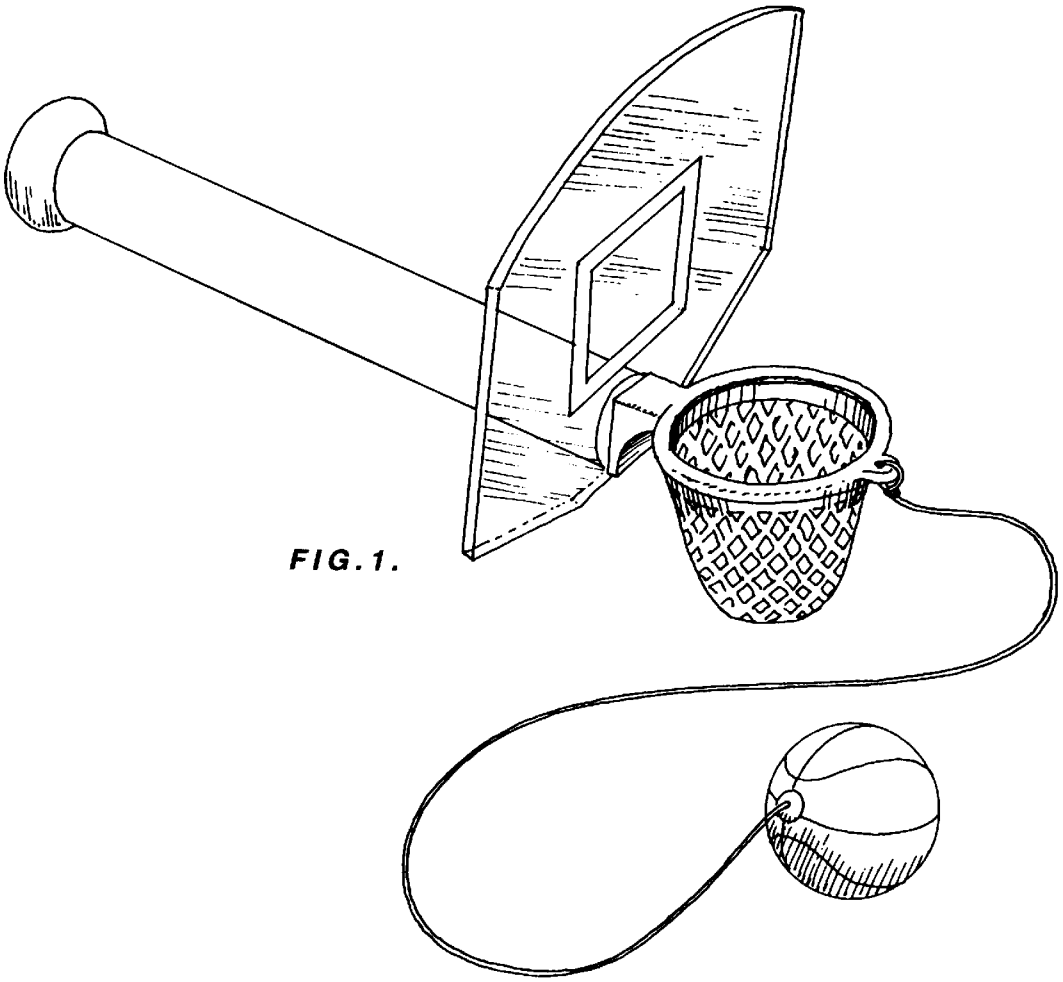
FIG. 1 is a front angle view of the preferred embodiment of the hand-held basketball game.
Figure 2:
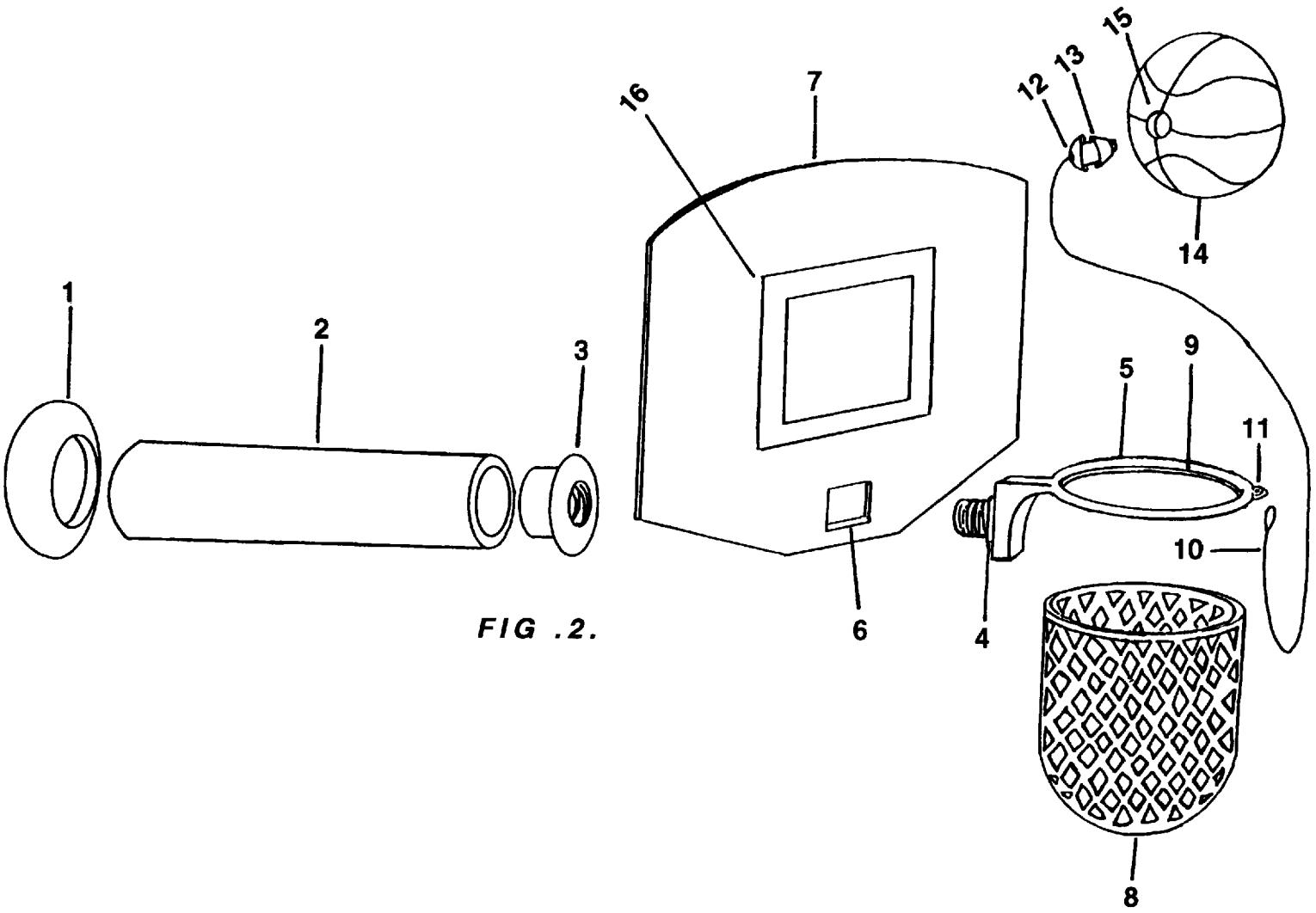
FIG. 2 is a front angle explode view of FIG. 1.
Figure 3:
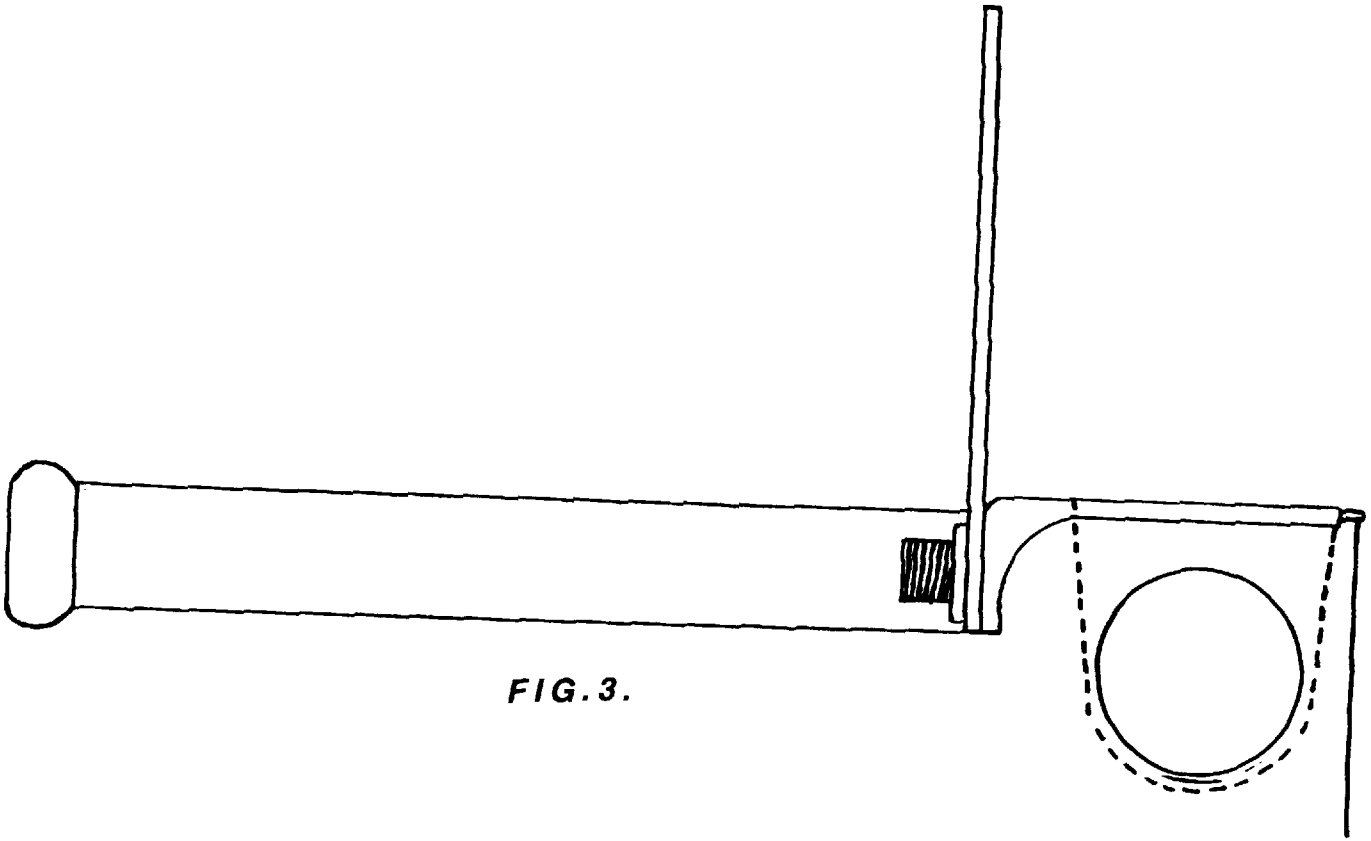
FIG. 3 is a side elevational view of the embodiment shown in FIG. 1.

As shown in the drawings, the preferred hand-held basketball game device, in accordance with the present invention, includes a circular-shaped disc 1 that is mounted to a short tubular handle 2. The short tubular handle 2 has a small, circular, spirally-grooved socket 3 that is inserted into the front section of the short tubular handle 2 which connects to a small spirally-grooved, square-headed screw 4 that protrudes from the rear neck of the miniature basketball game hoop 5. The square-headed, spirally-grooved screw 4 is inserted through a square opening 6 centered at the base of the beveled, miniature, transparent basketball game backboard 7. This screw connects to a small, circular, spirally-grooved socket 3, which connection supports the mainframe of the entire unit of the hand-held basketball game and functions as a locking mechanism when the basketball game is being assembled.

The miniature basketball game's cone-shaped net 8 is designed to be adjustable to the inner track circular lining 9 made within the miniature basketball game's hoop 5. This allows the miniature basketball game's cone-shaped net 8 to be assembled to, and disconnected from the miniature basketball game hoop 5. In order to attach the basketball game's thin rubber string 10 to the front loophole 11, located at the center section of the hand-held basketball game's circular miniature basketball game hoop 5, a small loophole 11 has been designed onto the miniature basketball game hoop's 5 front circular rim to allow the attachment of the basketball game's thin rubber string 10. The basketball game's thin rubber string 10 is inserted into the small loophole 11 and secured with a tightly-tied knot. The opposite end of the basketball game's thin rubber string 10 is inserted into a small, hollow hole 12 in the circular, wedge-rimmed plug 13 and is held stationary by a tightly-tied knot located at the base of the small, circular, wedge-rimmed plug 13, which functions as a locking device that secures the basketball game's thin rubber string 10 into the miniature basketball's 14 small circular hole 15, which is comprised of attaching both the basketball game's thin rubber string 10 to the front center of the miniature basketball game's hoop 5 and also to the basketball's circular, rimmed wedge plug 13 that is inserted into the miniature basketball game's small circular hole 15 that is located in the middle of the miniature basketball 14. The hand-held basketball game is also comprised of a small white square 16 designed within the center of the beveled miniature transparent basketball game's backboard 7.

The hand-held basketball game was designed for looping a miniature basketball into a miniature basketball game hoop, utilizing a short, tubular handle with a miniature, beveled, transparent basketball game backboard, with a miniature cone-shaped net, comprising of a thin rubber string connected to a miniature basketball. The objective of the hand-held basketball game is to be played exactly the way you would play a regular basketball game, on a basketball court. The only difference is the technique and concept of how the hand-held basketball game is played. Instead of throwing the basketball into a regular basketball game hoop, as in a real game of basketball, each player will take turns in looping the miniature basketball into a miniature basketball game hoop, which is attached to a long, thin string of rubber. This can be done by looping the miniature basketball into both the miniature basketball game hoop and miniature basketball game cone-shaped net.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited, not by this detailed description, but rather by the claim appended hereto.

I claim:

1. A hand-held basketball game comprising:

A. A circular-shaped disc mounted to the base of a short tubular handle;

B. A short tubular handle that has a spirally-grooved socket inserted within the front section of the short tubular handle;

C. A beveled miniature transparent basketball backboard with a small square opening located at the center base of the beveled miniature basketball game backboard;

D. A spirally-grooved, square-headed screw that protrudes from the rear curved neck of a miniature basketball game hoop;

E. A miniature basketball game hoop with a curved neck base;

F. A small loophole that is located at the center outer rim of the miniature basketball game hoop, which allows the rubber string to be attached to the center of the miniature basketball game hoop outer rim;

G. A circular track lining, designed within the inner circle frame of the miniature basketball game hoop that allows the basketball net to be adjustable to the miniature basketball game hoop;

H. A miniature cone-shaped basketball game net that assembles and disconnects from the inner lining of the miniature basketball game hoop;

I. A circular wedge-rimmed plug which is inserted inside of a small circular hole located in the center of the miniature basketball;

J. A miniature basketball that has a small circular hole located within the center of the miniature basketball.

* * * * *